US009393595B2

(12) United States Patent
Ishii et al.

(10) Patent No.: US 9,393,595 B2
(45) Date of Patent: Jul. 19, 2016

(54) ABRASIVE FILM FABRICATION METHOD AND ABRASIVE FILM

(71) Applicant: EBARA CORPORATION, Tokyo (JP)

(72) Inventors: Yu Ishii, Tokyo (JP); Hiroyuki Kawasaki, Tokyo (JP); Masayuki Nakanishi, Tokyo (JP); Kenya Ito, Tokyo (JP)

(73) Assignee: Ebara Corporation, Tokyo (JP)

( * ) Notice: Subject to any disclaimer, the term of this patent is extended or adjusted under 35 U.S.C. 154(b) by 61 days.

(21) Appl. No.: 13/950,066

(22) Filed: Jul. 24, 2013

(65) Prior Publication Data

US 2014/0030962 A1 Jan. 30, 2014

(30) Foreign Application Priority Data

Jul. 25, 2012 (JP) ..... 2012-164417

(51) Int. Cl.
*B05D 5/02* (2006.01)
*B24D 11/00* (2006.01)

(52) U.S. Cl.
CPC *B05D 5/02* (2013.01); *B24D 11/00* (2013.01); *B24D 11/001* (2013.01)

(58) Field of Classification Search
None
See application file for complete search history.

(56) References Cited

U.S. PATENT DOCUMENTS

| | | | | | |
|---|---|---|---|---|---|
| 3,812,082 | A * | 5/1974 | Jones | 528/73 | |
| 4,729,771 | A * | 3/1988 | Kunimoto et al. | 51/298 | |
| 4,927,431 | A * | 5/1990 | Buchanan et al. | 51/298 | |
| 4,974,373 | A * | 12/1990 | Kawashima et al. | 51/295 | |
| 5,681,612 | A * | 10/1997 | Benedict | B24D 3/28 | 427/202 |
| 6,291,054 | B1 * | 9/2001 | Thomas | A47J 36/02 | 427/384 |
| 6,340,519 | B1 * | 1/2002 | Tanaka | C09D 5/024 | 427/373 |
| 2010/0255764 | A1 | 10/2010 | Watanabe et al. | | |

FOREIGN PATENT DOCUMENTS

| | | | |
|---|---|---|---|
| JP | S62-074577 | A | 4/1987 |
| JP | S63-251159 | A | 10/1988 |
| JP | H06-278037 | | 10/1994 |
| JP | 09-235388 | A | 9/1997 |
| JP | 2000-094343 | A | 4/2000 |
| JP | 2008-221399 | A | 9/2008 |
| JP | 2009-125864 | | 6/2009 |
| JP | 2012-179704 | A | 9/2012 |

* cited by examiner

*Primary Examiner* — Michael P Rodriguez
(74) *Attorney, Agent, or Firm* — Baker & Hostetler LLP

(57) ABSTRACT

A method for fabricating an abrasive firm includes preparing a base film, coating the base film with a first paint which contains no abrasive grain but contains a binder resin, and drying the paint to form a first layer. The method further includes coating the first layer with a second paint which contains the abrasive grains and the binder resin, and drying the paint to form a second layer. The method further includes heating the first layer and the second layer for imidization.

17 Claims, 12 Drawing Sheets

Fig. 7

| SAMPLES | BASE MATERIAL + APPLIED LAYERS | Grain size | PAINT FORMULATION Ratio |
|---|---|---|---|
| EXAMPLE 1 | PI BASE MATERIAL + (two) polyimide layers | 9 μm | 15% DIAMOND + 18% POLYIMIDE |
| EXAMPLE 2 | PI BASE MATERIAL + (TWO) POLYIMIDE LAYERS | 9 μm | 15% DIAMOND + 18% POLYIMIDE |
| COMPARISON EXAMPLE 1 | PET BASE MATERIAL + POLYESTER | 9 μm | 60% DIAMOND + POLYESTER |
| COMPARISON EXAMPLE 2 | PI BASE MATERIAL + (ONE) POLYIMIDE LAYER | 9 μm | 15% DIAMOND + 18% POLYIMIDE |
| COMPARISON EXAMPLE 3 | PI BASE MATERIAL + (ONE) POLYIMIDE LAYER | 9 μm | 15% DIAMOND + 18% POLYIMIDE |

COMPARISON EXAMPLE 1

COMPARISON EXAMPLE 2, 3

EXAMPLE 2

EXAMPLE 2

COMPARISON EXAMPLE 1

COMPARISON EXAMPLE 2

COMPARISON EXAMPLE 2

*Fig. 11*

| SAMPLES | BASE MATERIAL + APPLIED LAYERS | ROUGHNESS INDEX VALUES (Ra, Pv) |
|---|---|---|
| EXAMPLE 1 | PI BASE MATERIAL + (TWO) POLYIMIDE LAYERS | Ra : 1.687E+02<br>Pv : 3.493E+03 |
| EXAMPLE 2 | PI BASE MATERIAL + (TWO) POLYIMIDE LAYERS | Ra : 8.653E+01<br>Pv : 9.416E+02 |
| COMPARISON EXAMPLE 1 | PET BASE MATERIAL + POLYESTER | Ra : 7.545E+01<br>Pv : 1.095E+03 |
| COMPARISON EXAMPLE 2 | PI BASE MATERIAL + (ONE) POLYIMIDE LAYER | Ra : 9.908E+01<br>Pv : 9.630E+02 |
| COMPARISON EXAMPLE 3 | PI BASE MATERIAL + (ONE) POLYIMIDE LAYER | Ra : 5.645E+01<br>Pv : 1.022E+03 |

ABRASIVE FILM FABRICATION METHOD AND ABRASIVE FILM

CROSS-REFERENCE TO RELATED APPLICATIONS

This application claims priority under 35 U.S.C. 119 on Patent Application No. 2012-164417 filed in Japan on Jul. 25, 2012, the disclosure of which is hereby incorporated by reference herein in its entireties.

TECHNICAL FIELD

The present invention relates to an abrasive film.

BACKGROUND ART

Polishing (abrading) techniques are widely known in which an abrasive film is used for polishing. Such an abrasive film is fabricated by forming an abrasive layer on a surface of a base film (for example, a resin film, a fabric into which resin fibers are interwoven, a non-woven fabric made of resin fibers, a sheet of paper). The abrasive layer is formed by coating the surface of the base film with a paint and drying the paint to be cured and fixed. As a paint to coat the base film with, a paint is used in which abrasive grains and a binder resin (a bonding material, an adhesive material) are mixed together with the abrasive grains dispersed. The abrasive film is made into various forms such as a tape, a disk and a belt according to purposes of applications and shapes of objects to which the abrasive film is to be applied and is then used accordingly.

The application of the abrasive film is often limited to polishing a wide area of a flat surface of a brittle material (for example, glass and ceramic) for finishing, polishing an end portion of a bare silicone wafer which is uniform in material quality, and abrading a hard disk to form minute grooves (textures) therein. This is because a uniform and flat polished surface is required in polishing a part or a device which determines the performance of a product, for example, in polishing a surface of a semiconductor substrate, mirror polishing an edge portion of the semiconductor substrate, or polishing to finish a surface of a magnetic head or an optical lens while there are situations in which the use of the abrasive film is not suitable for polishing them.

SUMMARY OF INVENTION

According to an aspect of the invention, there is provided a method for fabricating an abrasive film. This method includes preparing a base film, coating the base film with a first paint which contains no abrasive grain but contains a binder resin, and drying the paint to form a first layer. This method further includes coating the first layer with a second paint which contains the abrasive grains and the binder resin, and drying the paint to form a second layer. This method further includes heating the first layer and the second layer for imidization.

BRIEF DESCRIPTION OF DRAWINGS

FIG. 7 is a chart showing a summary of samples prepared for polishing tests.

FIG. 11 is a chart showing the results of the polishing tests (on index values of surface roughness).

DESCRIPTION OF EMBODIMENTS

A. Embodiment

Figure 1:
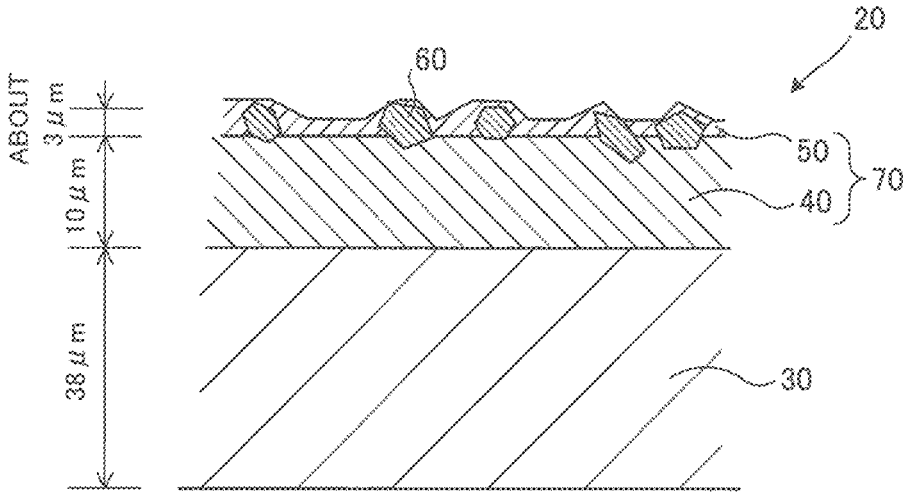
FIG. 1 is an explanatory diagram showing a sectional configuration of an abrasive film as an embodiment of the invention.

According to an embodiment of the invention, there is provided a method for fabricating abrasive film. This fabrication method includes preparing a base film, coating the base film with a first paint which contains no abrasive grain but contains a binder resin, and drying the paint to form a first layer. This method further includes coating the first layer with a second paint which contains the abrasive grains and the binder resin, and drying the paint to form a second layer. This method further includes heating the first layer and the second layer for imidization.

According to the abrasive film fabrication method, the abrasive film in which the abrasive grains are aligned with each other in projecting height can be fabricated in the process of imidization of the first layer and the second layer. The abrasive film fabricated by the use of this method can suppress the occurrence of uneven polishing or generation of scratches. Moreover, according to this fabrication method, since the abrasive grains are concentrated to the vicinity of the surface of the abrasive film, polishing can be performed preferably. In addition, since the abrasive grains are not stacked in layers in a direction of a thickness of the abrasive film, the amount of abrasive grains can be reduced. As a result, reduction in cost and saving of resources can be realized. Further, since the first layer and the second layer are subjected to imidization with the abrasive grains vertically sandwiched by the binder resins, the holding strength of the abrasive grains becomes high and the strength of the first layer and the second layer is increased. Because of this, the resulting abrasive film can polish a relatively hard object. Alternatively, the abrasive film can polish preferably an object having a shape in which working pressure tends to be concentrated. As result, the application of the resulting abrasive film is expanded. Alternatively, the polishing rate can be improved.

According to the embodiment of the invention, the coating and drying includes winding the base film on which the first layer and the second layer are formed into a roll with a separator sheet disposed on the second layer. The heating includes imidizing the first layer and the second layer of the wound base film. According to this method, the facility for imidization can be made small in size. Additionally, since a large amount of abrasive film can be treated at one time, the fabricating time of abrasive film per unit quantity can be reduced. Since the separator sheet is interposed between coils of the wound abrasive film, sticking of the coils of the wound abrasive film is prevented which would otherwise be the case as a result of imidization, or the fall of the abrasive grains is prevented which would otherwise be caused by separating the coils of the abrasive film which stick to each other.

According to the embodiment of the invention, the heating is executed by heating the first and second layers in a vacuum baking furnace at temperature of 200° C. or higher and 350° C. or lower for one hour or longer and four hours or shorter. According to this method, the first layer and the second layer can be imidized efficiently.

According to the embodiment of the invention, the prepared base film is formed from polyimide. According to this method, the abrasive film can be fabricated whose strength is higher than that of a conventional abrasive in which PET and the like are used for a base film thereof.

According to the embodiment of the invention, the prepared base film is fully imidized. According to this method, since the base film with high strength is handled in fabricating the abrasive film, the handling properties of the base film are enhanced.

According to the embodiment of the invention, the binder resin contains polyimide. According to this method, the first layer and the second layer can preferably be imidized.

According to the embodiment of the invention, a coating thickness of the first paint after being dried is in a range from a thickness equal to an average grain size of the abrasive grains to a thickness of three times as large as the average grain size. According to this method, in the heating, it is possible to obtain the first layer having a preferable thickness for the abrasive grains of a larger grain size to sink into the base film. As a result, the abrasive grains can preferably be aligned with each other in projecting height. In addition, there is no such situation in which the first layer is formed to an excessive thickness.

According to the embodiment of the invention, a thickness of the second layer after being dried is in a range from one fifth of an average grain size of the abrasive grains to one half of the average grain size of the abrasive grains. According to this method, a thickness in which the abrasive grains as cutting blades are covered can be controlled preferably.

According to the embodiment of the invention, the prepared base film has a thickness of 10 μm or larger and 50 μm or smaller. According to this method, the base film has a sufficient thickness, whereby the handling properties of the base film are improved. In addition, the base film is prevented from becoming too thick, and therefore, when polishing an uneven object (for example, an edge or a curved surface), the resulting abrasive film can follow preferably the shape of the uneven object.

According to the embodiment of the invention, viscosities of the first paint and the second paint are prepared by a solvent to those of 10000 mPa·s/25° C. or larger and 30000 mPa·s/25° C. or smaller. A ratio of a resin solid content to the whole of the first paint is 5 wt % or larger and 50 wt % or smaller. A ratio of the abrasive grains in the second paint to a resin solid content in the second paint is 5 wt % or larger and 30 wt % or smaller. A ratio of the resin solid content in the second paint to the whole of the second paint is 10 wt % or larger and 50 wt % or smaller. According to this method, the viscosities can be prepared preferably, and preferable dispersions of the respective constituents of the first paint and the second paint can be obtained. In addition, since the ratio of the resin solid content in the first layer is maintained preferably, it is possible to obtain a preferable coating thickness for the first layer and a preferable dispersion of the binder resin in the first paint. Additionally, since the ratios of the resin solid content and the abrasive grains contained in the second layer are maintained preferably, it is possible to obtain a preferable coating thickness for the second layer, a preferable abrasive grain holding strength, and preferable dispersions of the binder resin and the abrasive grains in the second paint.

According to the embodiment of the invention, the ratio of the resin solid content to the whole of the first paint is 20 wt %. The ratio of the abrasive grains contained in the second paint to the content of resin solid mater in the second paint is 15 wt %. The ratio of the resin solid content in the second paint to the whole of the second paint is 18 wt %. According to this method, the advantage described above can be enhanced further.

According to the embodiment of the invention, the solvent is an alkyl amide solvent. According to this method, since the solvent has high polarity, the dispersions of the binder resin and the abrasive grains can be enhanced.

According to the embodiment of the invention, an abrasive film is provided. This abrasive film includes a base film and a surface layer that is formed on one surface of the base film and that contains abrasive grains and a binder resin solid content. All of the abrasive grains are situated within a half portion of a thickness of the surface layer. The half portion lies opposite to the base film. According to the abrasive film, the uniformity in projecting height of the abrasive grains can be improved. Consequently, the occurrence of uneven polishing and generation of scratches can be suppressed. Additionally, the amount of abrasive grains can be reduced, thereby making it possible to realize the reduction in cost and saving of resources. In addition, the abrasive film has the high holding strength of abrasive grains, whereby a relatively hard object can be polished by the abrasive film. Alternatively, the abrasive film can also polish preferably an object having a shape in which working pressure tends to be concentrated locally. As a result, the application of the abrasive film is expanded. Alternatively, the polishing rate can be increased.

According to the embodiment of the invention, method for polishing a substrate is provided. This polishing method includes rotating a substrate, bringing the abrasive film provided in the way described above into contact with a portion of the rotating substrate which is to be polished to polish the portion to be polished. According to this polishing method, the same advantage as those described above can be provided.

According to the embodiment of the invention, the portion to be polished is a circumferential edge portion of the substrate. The substrate polishing method can preferably be applied to polishing the circumferential edge portion of the substrate. Hereinafter, embodiments of the invention will be described in detail.

A-1. Configuration of Abrasive Film 20:

FIG. 1 shows a sectional configuration of an abrasive film 20 according to the embodiment of the invention. The abrasive film 20 includes a base film 30, a first layer 40, and a second layer 50. The first layer 40 is formed on one surface of the base film 30. The second layer 50 is formed on the first layer 40. The second layer 50 includes abrasive grains 60. Most of the abrasive grains 60 are situated in an interior of the second layer 50. A part of the abrasive grains 60, more specifically, that of the abrasive grains 60 whose grain sizes are relatively large sink into the first layer 40. Surfaces of the abrasive grains 60 may be covered completely by the second layer 50 or may be exposed partially from a surface of the second layer 50.

The base film 30 not only imparts a required strength to the abrasive film 20 but also increases the handling properties of the abrasive film 20. In this embodiment, the base film 30 is formed from polyimide. Using polyimide can enhance the strength of the abrasive film 20 higher than that of a conventional abrasive film using a base film formed from PET and the like.

The material of the base film 30 is not limited to polyimide, and hence, arbitrary resin materials can be used for the base film 30, provided that they have heat resistance to frictional heat generated during polishing, strength according to the material quality and shape of an object to be polished, and sufficient adhesion properties to the first layer 40. For example, various thermosetting resins such as phenol resin, epoxy resin and polyamide-imide resin may be used for the base film 30.

In this embodiment, the thickness of the base film 30 is 38 μm. According to another embodiment, the thickness of the base film 30 is 10 μm or larger. Using the base film 30 which is so thick makes it difficult for wrinkles or rupture to be generated in the base film 30, and increases the handling properties of the abrasive film 20 fabricated, when fabricating the abrasive film 20. In addition, according to a further embodiment, the thickness of the base film 30 is 50 μm or smaller. Using the base film 30 which is so thick enables the abrasive film 20 to follow preferably a non-flat shape (for example, an edge or a curved surface) of an object to be polished when polishing the object by the use of the abrasive film 20. Namely, applications of the abrasive film 20 can be expanded.

The first layer 40 and the second layer 50 have a function to hold the abrasive grains 60. The first layer 40 also functions as a substrate layer for the second layer 50. In this embodiment, the first layer 40 and the second layer 50 are formed from polyimide. However, arbitrary resin materials which can be imidized can be used for the first layer 40 and the second layer 50. For example, various thermosetting resins such as phenol resin, epoxy resin, and polyamide-imide resin may be used for the first layer 40 and the second layer 50. According to one embodiment, the same resin material is used for the first layer 40 and the second layer 50 from the viewpoint of adhesion properties. According to another embodiment, materials containing the same resin material are used for the first layer 40 and the second layer 50. For example, the first layer 40 is formed from polyimide, and the second layer 50 is formed from polyimide and a filler. The filler enhances the affinity between polyimide and the abrasive grains 60. For example, silica grains can be used as the filler. Additionally, using the same material as that of the base film 30 for the first layer 40 can enhance the adhesion of the first layer 40 to the base film 30.

In this embodiment, the thickness of the first layer 40 is 10 μm. The thickness of the second layer 50 is about 30 μm. According to another embodiment, the thickness of the second layer 50 is ⅕ of the average grain size of the abrasive grains 60 or larger. Using the second layer 50 which is so thick can obtain a preferable level of holding strength of the abrasive grains 60. In addition, according to a further embodiment, the thickness of the second layer 50 is ½ the average grain size of the abrasive grains 60 or smaller. Using the second layer 50 which is so thick prevents the abrasive grains 60 from being covered excessively by the second layer 50. As a result, the abrasive grains 60 are allowed to function as cutting blades in a preferable fashion.

The abrasive grains 60 are grains of an abrading or polishing material, and in polishing, portions of the abrasive grains 60 which are situated at a front surface side of the second layer 50 operate as cutting blades. For example, diamond grains, silicone carbide (SiC), alumina ($Al_2O_3$), silica ($SiO_2$), and manganese oxide ($MnO_2$) can be used for the abrasive grains 60. In this embodiment, industrial diamond (polycrystalline diamond) is used for the abrasive grains 60. In this embodiment, the average grain size of the abrasive grains 60 is 9 μm. However, the average grain size of the abrasive grains 60 can be set in the range from about 0.1 μm to about 20 μm as required.

In this application, the grain size of the abrasive grains 60 is measured by the use of a laser diffraction method (also referred to as Microtrac method). As a measuring device, a Microtrac X100 (commercially available from NIKKISO Co., Ltd) is used. When used herein, the "average grain size" means a grain size (D50) at 50% of an integrated value in a grain size distribution which is obtained by the laser diffraction method.

In the abrasive film 20 described above, a division between the first layer 40 and the second layer 50 is a conceptual division based on a fabrication method of the abrasive film 20, which will be described below, and hence, it does not always happen that the first layer 40 and the second layer 50 can be identified as separate layers based on the division after the abrasive film 20 is fabricated. For example, in the case of the first layer 40 and the second layer 50 being formed from the same material, a boundary between the first layer 40 and the second layer 50 cannot be identified in reality. Because of this, the first layer 40 and the second layer 50 can also be regarded as a single surface layer 70.

As shown in FIG. 1, in the abrasive film 20, all of the abrasive grains are situated in a half portion of the surface layer 70 in a direction of a thickness of the surface layer 70 (whose thickness is about 13 μm) which lies opposite to the base film 30, that is, within a front surface side half portion of the surface layer 70. The abrasive grains 60 are held near the front surface of the surface layer 70. Namely, there is no such situation in which a plurality of abrasive grain 60 are stacked in a direction of a thickness of the base film 30. Because of this, each of the abrasive grains 60 is held in such a state that all or almost all of the surfaces of the abrasive grains 60 are in contact with the resin material of the surface layer 70. Consequently, the abrasive film 20 has the high holding strength of the abrasive grains 60, whereby a relatively hard object or an object having a shape in which working pressure tends to be increased can be polished by the abrasive film 20. Namely, applications of the abrasive film are expanded. Alternatively, the polishing rate can be increased. For example, the abrasive film 20 can also be used preferably to polish a bevel portion or a notched portion of a wafer. Moreover, since the surface layer 70 is formed mainly from polyimide, the holding strength of the abrasive grains 60 is enhanced further compared with an abrasive film in which polyester and the like are used for a surface layer thereof.

Additionally, since the abrasive grains 60 are not stacked in the direction of the thickness, the amount of abrasive grains 60 to be used can be reduced. As a result, with the abrasive film 20, the reduction in production cost and saving of resources are realized. Further, respective projecting heights of the abrasive grains 60 do not vary largely. Because of this, in polishing an object to be polished, projections of the abrasive grains 60 come to contact the object to be polished almost uniformly, and therefore, the occurrence of uneven polishing and generation of scratches can be suppressed. In addition, no abrasive grain 60 exists on contact surfaces of the base film 30 and the first layer 40, and therefore, a high adhesion can be realized between the base film 30 and the first layer 40. These characteristics of the abrasive film 20 are realized by a fabrication method of the abrasive film 20, which will be described later.

In addition, in the abrasive film 20, since a polyimide, which has high strength, is used as the material of the base film 30, the tensile strength and rupture strength of the substrate itself are high. Because of this, compared with conventional abrasive films in which PET, PEN, PP, PE are broadly used as a base material, the abrasive film 20 can suppress the occurrence of a problem inherent in the conventional abrasive films that an abrasive tape is stretched during the fabrication process or the process is not stable. The problems tend to easily be caused in the event that the width of the abrasive film is narrow, for example, 10 mm or narrower.

Figure 2:
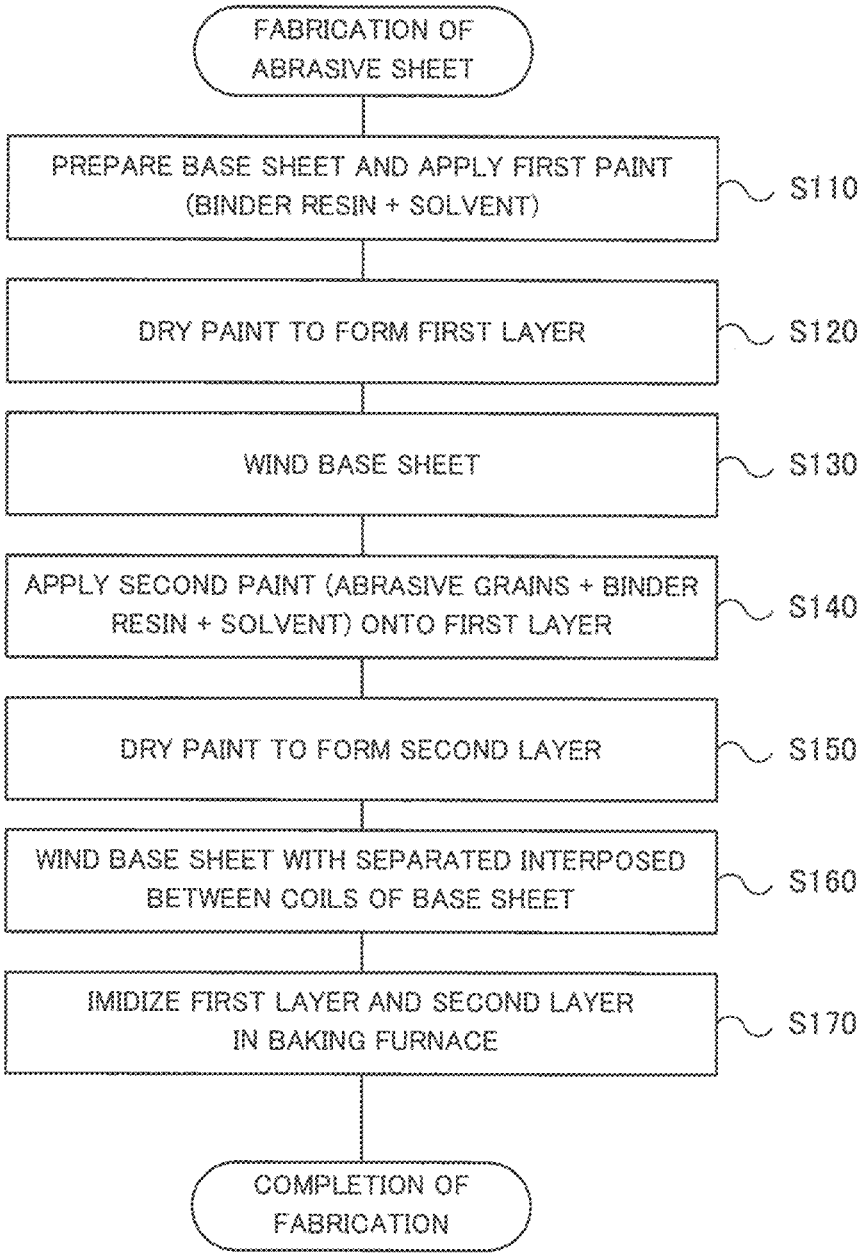
FIG. 2 is a flowchart showing an abrasive film fabrication process.
Figure 3:
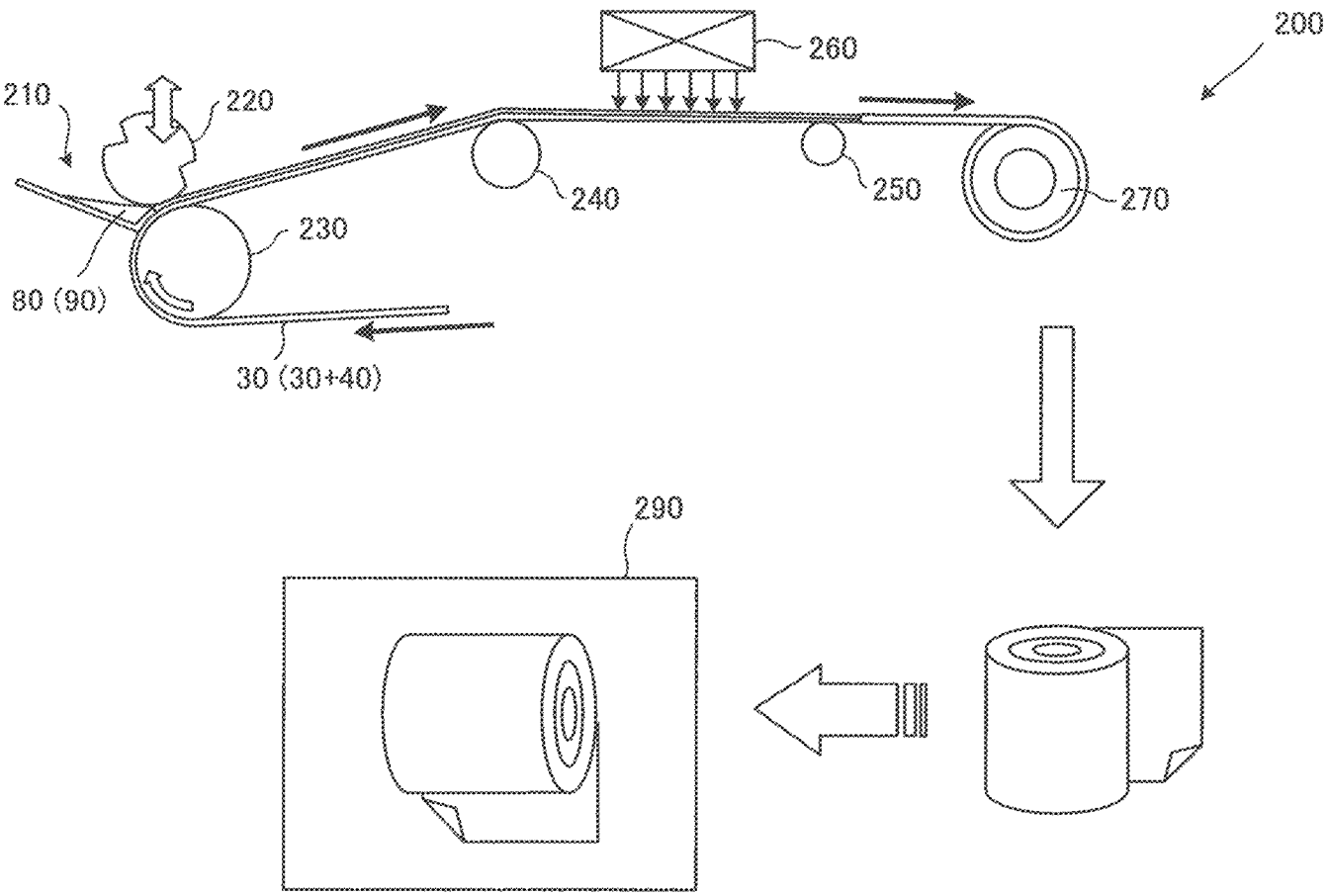
FIG. 3 is an explanatory diagram showing schematically the configuration of an abrasive film fabrication system.

A-2. Fabrication Method of Abrasive Film 20:

FIG. 2 is a flowchart showing a fabrication process of the abrasive film 20 that has been described above. FIG. 3 shows schematically the configuration of a fabrication system 200 for the abrasive film 20. As shown in FIG. 2, in fabrication of the abrasive film 20, firstly, the base film 30 is prepared, and one surface of the base film 30 is coated with a first paint 80 (step S110).

In this embodiment, POMIRAN N38 (commercially available from ARAKAWA CHEMICAL INDUSTRIES, LTD.), which is one kind of polyimide, is used for the base film 30. According to one embodiment, a film that is fully imidized in advance is used for the base film 30. Using the film so imidized means that the base film 30 whose strength is high is handled, and therefore, the handling properties of the base film 30 are enhanced. Whether or not the base film 30 is fully imidized can be determined by imidizing the base film 30 again and comparing weights of the base film 30 before and after the re-imidization thereof. For example, an area of 5 $cm^2$ is cut out from the base film 30 as a sample, and the sample is heated at 300° C. for one hour to thereby be imidized. As a result, in case the sample is such that an imidization ratio, which is calculated from a change in weight and an amount of by-product water produced in the process of imidization, is equal to or larger than 70%, it can be said that the sample is fully imidized.

The first paint 80 contains a solvent and a binder resin. A resin solid content of the binder resin constitutes finally a constituent of the first layer 40. Although the binder resin remains highly viscous as it is, by adding the solvent to the binder resin, the viscosity of the first paint 80 is adjusted to a viscosity which is appropriate for application of the first paint 80. In this embodiment, POLYIMIDE-SILICA HYBRID VARNISH HBI-58 (commercially available from ARAKAWA CHEMICAL INDUSTRIES, LTD.) is used for the binder resin. For the solvent, for example, an alkylamide solvent is used. The alkylamide solvent has a high polarity, and therefore, whether it is organic or inorganic, a solute can preferably be dispersed in the alkylamide solvent. In this embodiment, DMAc (dimethylacetamide) is used for the alkylamide solvent. However, DMF (dimethylformamide) and the like may be used for the alkylamide solvent.

In this embodiment, the first paint 80 is prepared by solving 50 g DMAc for 200 g binder resin, stirring the mixture, and degassing and deaerating it in a vacuum chamber. A ratio of a resin solid content in the binder resin to the whole of the first paint 80 is 20 wt %. In this embodiment, the viscosity of the provided binder resin is in the range from 25000 to 30000 mPa·s/25° C., and the viscosity of the first paint 80 is adjusted to 10000 to 20000 mPa·s/25° C. by adding the solvent.

The prepared first paint 80 is applied to one surface of the base film 30. In this embodiment, the first paint 80 is applied to the base film 30 by the use of a comma coating method. Specifically, as shown in FIG. 3, firstly, the base film 30 which is wound into a roll (here, a roll of base film 30 which is 300 mm wide and about 20 m long) is set in the fabrication system 200 (not shown in the figure), and the base film 30 is unwound to be fed out sequentially between a comma roll 220 and a coating roll 230. By doing so, the first paint 80 stored in a coater dam 210 is applied to the base film 30. A feed-out speed (a coating speed) of the base film 30 can be, for example, 0.5 m/min.

A coating thickness can be controlled by adjusting a gap between the comma roll 220 and the base film 30. According to one embodiment, the coating thickness of the first paint 80 is equal to or larger than the average grain size of the abrasive grains 60 after the first paint 80 is dried in step S120, which will be described later. By doing so, it is possible to obtain a preferable thickness of the first layer 40 for grains which have larger grain diameters among the abrasive grains 60 to sink into the first layer 40 towards the base film 30. In addition, according to another embodiment, the coating thickness of the first paint 80 is three times larger than the average grain size of the abrasive grains 60 or smaller after the first paint 80 is dried in step S120, which will be described later. By doing so, the first layer 40 is not unnecessarily formed to an excessive thickness.

After the first paint 80 is applied to the base film 30, as shown in FIG. 2, the first paint 80 applied is then dried to thereby form the first layer 40 (step S120). In this embodiment, the first paint 80 is dried by holding the base film 30 to which the first paint 80 is applied at 130° C. for two minutes. Specifically, as shown in FIG. 3, the base film 30 to which the first paint 80 is applied is carried on rollers 240, 250 to thereby be dried sequentially by a warm-air drier 260 which is provided above a carrying line of the base film 30. A heating range of the warm-air drier 260, for example, spreads over an area of 1.0 m long in a feeding direction of the base film 30.

When the first paint 80 is dried, then, as shown in FIG. 2, the base film 30 on which the first layer 40 is formed is wound into a roll (step S130). As shown in FIG. 3, the base film 30 is wound around a hollow cylindrical core 270.

When the base film 30 is wound fully around the core 270, then, as shown in FIG. 2, the wound base film 30 is sequentially unwound to be fed out, and a second paint 90 is applied onto the first layer 40 (step S140). The application of the second paint 90 in step S140 is performed in a similar way to the way in which the first paint 80 is applied in the step S110 by the use of the fabrication system 200 (refer to FIG. 3). Although the facility for applying the first paint 80 is provided separately from the facility for applying the second paint 90, in FIG. 3, those paint application facilities are shown as the paint application facility common for both the first paint 80 and the second paint 90 for the sake of simplifying the illustration.

The second paint 90 contains a solvent, the abrasive grains 60, and a binder resin. A resin solid content of the binder resin constitutes finally a constituent of the second layer 50. In this embodiment, the binder resin used for the second paint 90 is of the same kind as the binder resin used for the first paint 80. In this embodiment, the solvent and the binder resin used for the second paint 90 are of the same kind as the solvent and the binder resin used for the first paint 80. In addition, the second paint 90 is prepared in a similar way to the way in which the first paint 80 is done. Namely, the viscosity of the second paint 90 is adjusted by adding the solvent to the binder resin. Then, the resulting mixture is stirred and is thereafter degassed and deaerated in a vacuum chamber. In this embodiment, a ratio of abrasive grains 60 in the second paint 90 to a resin solid content in the second paint 90 is 15 wt %. In addition, a ratio of the resin solid content of the binder resin to the whole of the second paint 90 is 18 wt %.

According to one embodiment, the viscosities of the first paint 80 and the second paint 90 are 10000 mPa·s/25° C. or larger and 30000 mPa·s/25° C. or smaller. When the viscosities of the first and second paints 80, 90 are adjusted to viscosities falling in such a range, preferable dispersions of the respective constituents of the first paint 80 and the second paint 90 can be obtained. According to the one embodiment, a ratio of the resin solid content to the whole of the first embodiment 80 is 5 wt % or larger and 50 wt % or smaller. By doing so, it is possible to obtain a preferable film thickness for the first layer 40 and a preferable dispersion of the binder resin in the first paint 80. According to the one embodiment, a ratio of the abrasive grains contained in the second paint 90 to the resin solid content in the second paint 90 is 5 wt % or larger and 30 wt % or smaller. By doing so, it is possible to obtain a preferable film thickness for the second layer 50, a preferable holding strength for holding the abrasive grains 60, and a preferable dispersion of the binder resin and the abrasive grains 60 in the second paint 90. In addition, compared with a conventional abrasive film, the amount of abrasive grains 60 to be used can be reduced largely.

After the second paint 90 is applied to the base film 30, the applied second paint 90 is then dried to thereby form the second layer 50 (step S150). The drying operation in step S150 is performed in a similar way to the way adopted in step S120 described above by the use of the fabrication system 200 (refer to FIG. 3).

Figure 4:
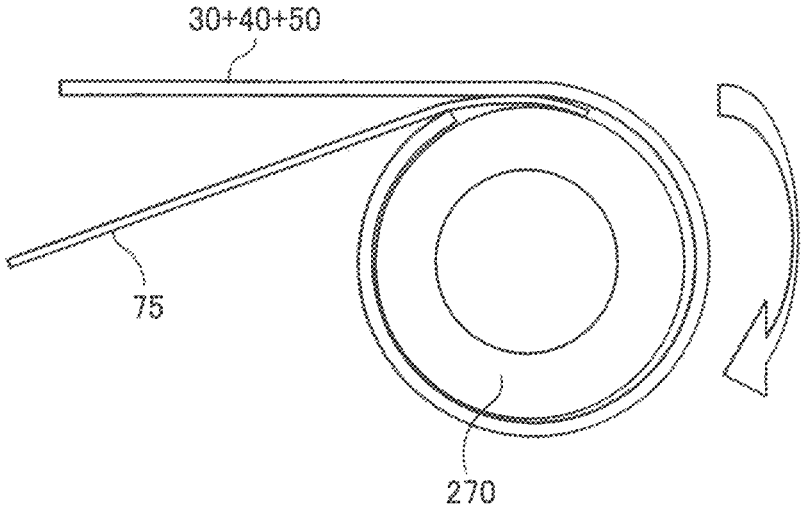
FIG. 4 is an explanatory diagram showing how to wind an abrasive film being fabricated.

When the second paint 90 is dried, then, the base film 30 on which the first layer 40 and the second layer 50 are formed is wound into a roll (step S160). The winding of the base film 30 in step S160 is performed in a similar way to the way in which the base film 30 is wound in step S130 described above by the use of the fabrication system 200 (refer to FIG. 3). However, in step S160, as shown in FIG. 4, the base film 30 on which the first layer 40 and the second layer 50 are formed is wound with a separator sheet 75 disposed on the second layer 50. In other words, the base film 30 is wound with the separator sheet 75 sandwiched between coils of the base film 30 which lie adjacent to each other in a radial direction.

Various kinds of materials can be used for the separator sheet 75 whose properties are not changed in temperature conditions of an imidization step (step S170), which will be described later. For example, a non-woven fabric made of polyimide fibers which are fully imidized or a surface-textured polyimide film can be used for the separator sheet 75. According to one embodiment, a sheet having permeability like a non-woven fabric is used for the separator sheet 75. By doing so, gas or water content produced during imidization is easily passed out through the separator sheet 75.

When the base film 30 on which the first layer 40 and the second layer 50 are formed is wound, finally, as shown in FIG. 2, the base film 30 is set in an interior of a vacuum baking furnace so that the first layer 40 and the second layer 50 are imidized (step S170). In this embodiment, the interior of the baking furnace is sealed up and vacuumed. Thereafter, the temperature in the interior of the baking furnace is increased gradually, and the base film 30 is held in the baking furnace under temperature condition of 250 to 300° C. for one to two hours. Then, nitrogen gas or dried air is supplied into the interior of the baking furnace so as to cool down the interior thereof naturally under normal pressures. By adopting the process described, the imidization (curing reaction) of polyimide resin can be completed more quickly than the imidization carried out under normal temperature and pressure conditions. The processing conditions in step S170 may be set as required. According to one embodiment, the processing conditions in step S170 are such that heating is carried out in the temperature range from 200° C. or higher to 350° C. or lower for one hour or longer and four hours or shorter. By heating the base film 30 under these conditions, it is possible to obtain an effective curing reaction.

In step S170, imidization (thermal curing reaction) starts from the second layer 50 and the peripheries of the abrasive grains 60, whose heat conductivity is high. Then, with the abrasive grains 60 forced to the first layer 40 side by a film of the second layer 50 which is cured earlier, the whole of the first layer 40 is imidized (cured) gradually, whereby the surface layer 70 (made up of the first layer 40 and the second layer 50) is formed near the surface of the second layer 50 so that the abrasive grains 60 are substantially aligned with each other in terms of projecting height.

According to one embodiment, in step S170, the wound base film 30 is set within the interior of the baking furnace 290 with a winding shaft oriented in a horizontal direction as shown in FIG. 3. By executing the imidization in such a state, the wound base film 30 is thermally expanded, thereby making it possible to suppress the occurrence of loose or shift of the roll. When the imidization is executed in this way, the abrasive film 20 is completed.

Figure 5:
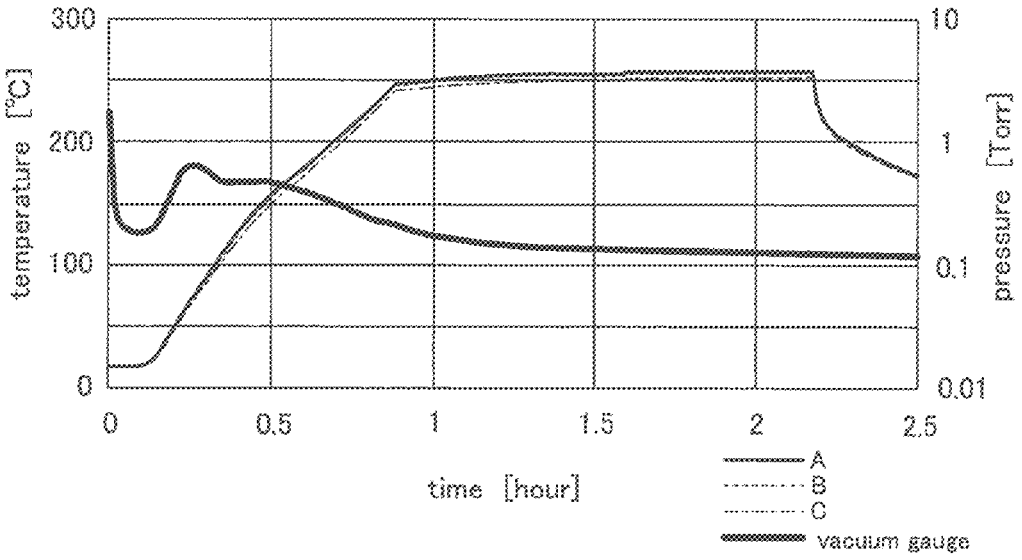
FIG. 5 is an explanatory diagram showing an example of a heating condition in an imidization process.
Figure 6:
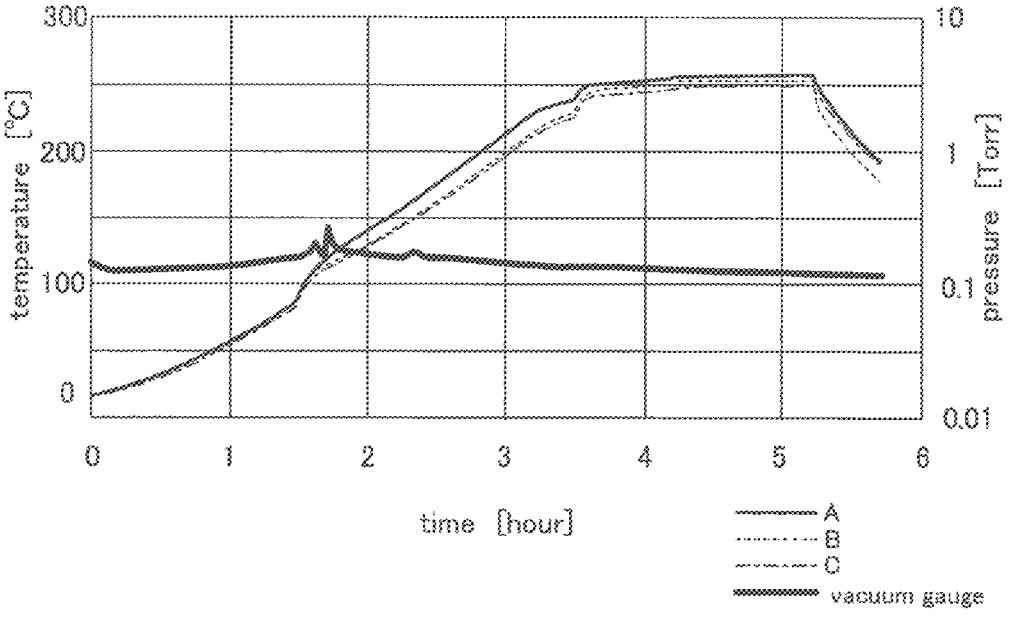
FIG. 6 is an explanatory diagram showing an example of a heating condition in the imidization process.

FIGS. 5 and 6 show one example of heating conditions in the imidization step (step S170). FIG. 5 shows a heating condition in which on the order of one hour is spent increasing the heating temperature to 250° C., and thereafter, the wound base film 30 is heated for about one hour. FIG. 6 shows a heating condition in which on the order of four hours is spent increasing the heating temperature to 250° C., and thereafter, the wound base film 30 is heated for about one hour. When the imidization is executed under the condition shown in FIG. 5, neither wrinkle nor tacking is produced in the base film 30 which is a target for imidization. When the imidization is executed under the condition shown in FIG. 6, wrinkles and/or tacking is produced in the base film 30 which is the imidization target for imidization. From these facts, according to one embodiment, the temperature increasing time to increase the heating temperature in the imidization step can be one hour or shorter.

According to the fabrication method of the abrasive film 20, the abrasive film 20 described above can be fabricated preferably. In addition, since the base film 30 on which the first layer 40 and the second layer 50 are formed is imidized in such a state that the base film 30 is wound into the roll, the facility for imidization can be made much smaller in size. For example, according to the method of this embodiment, the abrasive film 20 can be imidized within an installation space of several meters long. On the other hand, in the event that the base film 30 on which the first layer 40 and the second layer 50 are formed is heated for one hour in such a state that the base film 30 extends long flat by the use of a continuous annealing furnace while the base film 30 is being carried by a conveyor belt, and thereafter is cooled down, with a carrying speed of 0.5 m/min, a space of 60 m long is necessary to install the facility for increasing the heating temperature and for heating the base film 30, and a space of 30 m long is necessary to install the facility for cooling down the base film 30.

Moreover, according to the fabrication method of the abrasive film 20, since a large quantity of base film 30 can be processed at one time, the fabrication time of the abrasive film 20 per unit quantity can be reduced. Further, since the separator sheet 75 is sandwiched between the coils of the base film 30 on which the first layer 40 and the second layer 50 are formed, in imidizing the base film 30, the second layer 50 of the base film 30 and a rear surface (an opposite surface to the first layer 40 and the second layer 50) of the base film 30 that is disposed on the second layer 50 can be restrained from sticking to each other. Additionally, since the necessity of separating the coils of the base film 30 which stick to each other can be obviated, the fall of the abrasive grains 60 from the second layer 50 can also be restrained which would otherwise occur in association with the separation of the second layer 50 on the base film 30 from the rear surface of the base film 30.

A-3. Evaluation Tests

Some abrasive film samples were fabricated to evaluate the abrasive film 20 that has been described heretofore. FIG. 7 shows a summary of the samples fabricated. Samples of Examples 1, 2 are abrasive films 20 which were fabricated by the use of the fabrication method shown in FIG. 2, and have the sectional configuration shown in FIG. 1. The average grain size of abrasive grains 60 is 9 μm. A ratio of the abrasive grains 60 contained in the second paint 90 to a resin solid content in the second paint 90 is 15 wt %, and a ratio of the resin solid content of a binder resin (polyimide) to the whole of the second paint 90 is 18 wt %.

A sample of Comparison Example 1 is a conventional abrasive film. To fabricate Comparison Example 1, PET was used for a base film, and polyester was used as a binder resin. The abrasive film of Comparison Example 1 was fabricated by applying a paint containing a binder resin, abrasive grains, and a solvent to a base material and drying it. A ratio of the abrasive grains to the whole of the paint is 60 wt %. Comparison Examples 2, 3 differ from Examples 1, 2 in that they were fabricated by the use of the fabrication method shown in FIG. 2 in which forming the first layer 40 is omitted and are the same as Examples 1, 2 with respect to the other features.

Two types of abrasive grains having different grain shapes were used for these samples. Specifically, abrasive grains of a blocky type were used for the samples of Example 1, Comparison Example 1 and Comparison Example 2. Abrasive grains of an irregular type were used for the samples of Example 2 and Comparison Example 3. The grain size distribution of the blocky type abrasive grains is such that D10 is 5.12 μm, D50 is 6.84 μm, D90 is 9.76 μm, and D95 is 11.20 μm. The grain size distribution of the irregular type abrasive grains is such that D10 is 6.18 μm, D50 is 8.14 μm, D90 is 11.36 μm, and D95 is 12.86 μm. A largest grain size of the abrasive grains is 22.00 μm for each type. The grains size distribution of the irregular type abrasive grains is sharp, while the grains size distribution of the blocky type abrasive grains is broad.

Figure 8A:
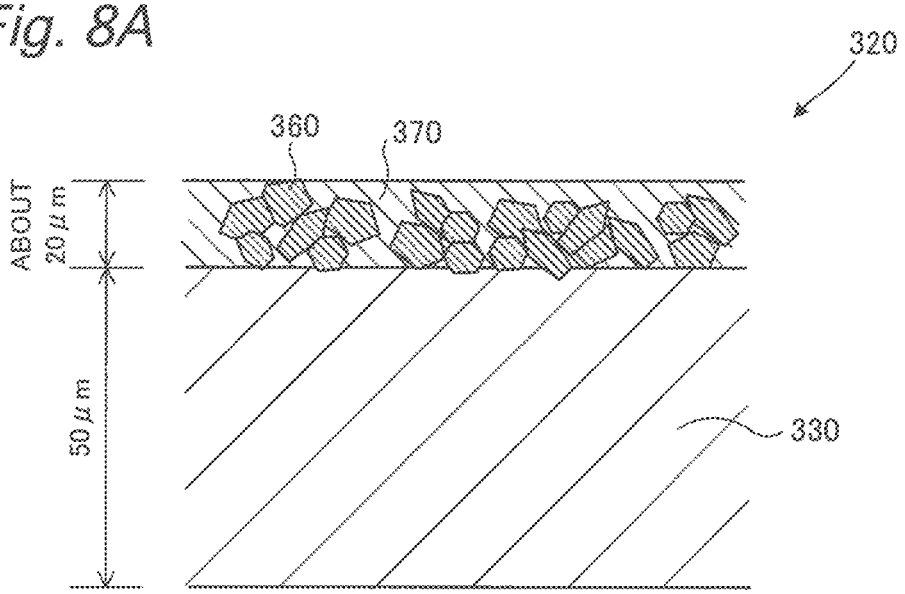
FIGS. 8A and 8B show explanatory diagrams showing sectional configurations of abrasive films prepared as comparison examples.
Figure 8B:
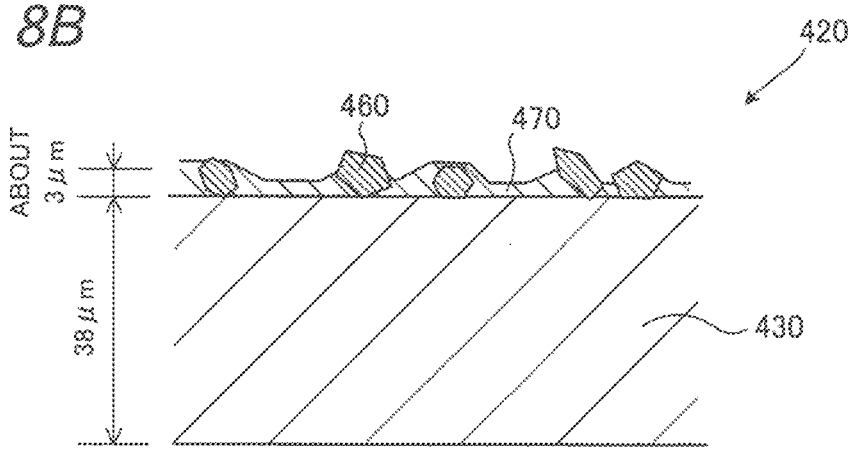

FIGS. 8A and 8B show sectional configuration of Comparison Examples 1 to 3 fabricated. As shown in FIG. 8A, an abrasive film 320 of Comparison Example 1 includes a base film 330 and a surface layer 370. The thickness of the base film 330 is about 50 μm, and the thickness of the surface layer 370 is about 20 μm. Abrasive grains 360 are stacked in a direction of a thickness and held in place in such a state. Since the abrasive grains 360 aggregate, an area of each abrasive grain 360 where the abrasive grain 360 is in contact with a resin material in the surface layer 370 is smaller than that of the abrasive grain 60 in the abrasive film 20 (refer to FIG. 1). Because of this, compared with the abrasive film 20, the holding force of the abrasive grains 360 is reduced. In addition, the existence of the abrasive grains 360 on a boundary between the base film 330 and the surface layer 370 reduces the bonding strength of the base film 330 and the surface layer 370, compared with the abrasive film 20. Additionally, most of the abrasive grains 360 are situated on a base film 330 side of the surface layer 370, which does not contribute to a polishing operation performed by the abrasive film 320 of Comparison Example 1.

As shown in FIG. 8B, an abrasive film 420 of Comparison Examples 2, 3 includes a base film 430 and a surface layer 470. The base film 430 corresponds to the base film 30 of the abrasive film 20, and the surface layer 470 corresponds to the second layer 50 of the abrasive film 20. Namely, the abrasive film 420 does not have a layer which corresponds to the first layer 40 of the abrasive film 20. Abrasive grains 460 are held in the surface layer 470 in such a state that the abrasive grains 460 are not stacked in a direction of a thickness. However, a part of a surface of the abrasive film 460 is in contact with the base film 430, and therefore, as with Comparison Example 1, compared with the abrasive film 20, the holding force of the abrasive grains 460 and the bonding strength between the base film 430 and the surface layer 470 are reduced. Moreover, since a first layer like the first layer 40 of the abrasive film 20 is not formed on the base film 430, the abrasive films 460 cannot sink into a base film 430 side of the surface layer 470. As a result, projecting heights of the abrasive grains 460 having large grain sizes and the abrasive grains 460 having small grain sizes do not become uniform.

Figure 9A:
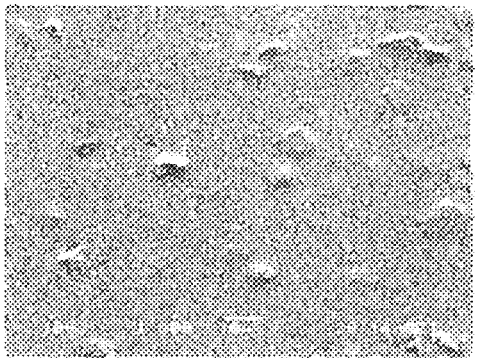
FIGS. 9A to 9E show microscopic photos showing the results of observation of the sample abrasive films.
Figure 9B:
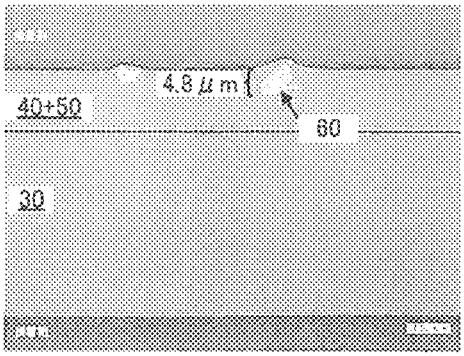
Figure 9C:
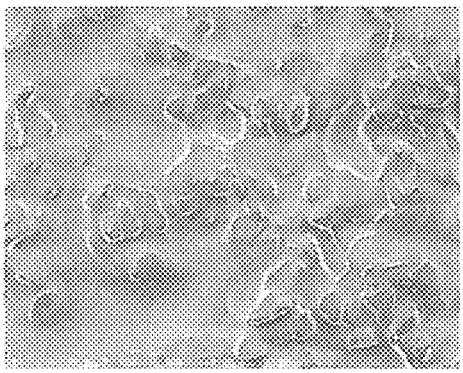
Figure 9D:
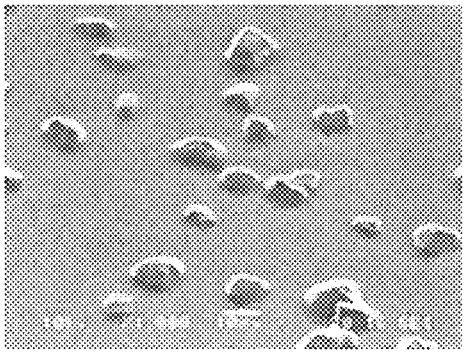
Figure 9E:
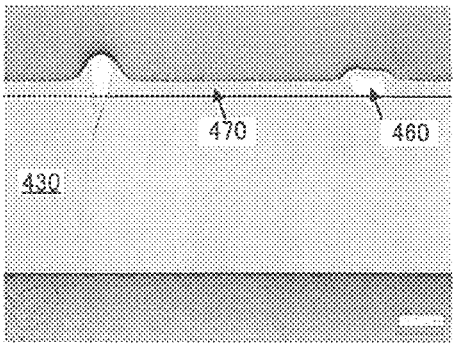

FIGS. 9A to 9E show microscopic photos showing the results of observation of Example 2 and Comparison Examples 1, 2 (refer to FIGS. 8A and 8B). FIG. 9A shows a surface of Example 2, and FIG. 9B shows a section of Example 2. It can be confirmed from FIGS. 9A and 9B that projecting heights of the abrasive grains 60 are almost uniform in Example 2. FIG. 9C shows a surface of Comparison Example 1. It can be confirmed from FIG. 9C that in Comparison Example 1, there are a number of abrasive grains 360, which aggregate. FIG. 9D shows a surface of Comparison Example 2, and FIG. 9E shows a section of Comparison Example 2. It can be confirmed from FIGS. 9D and 9E that the projecting heights of the abrasive grains 460 are not uniform in Comparison Example 2. It should be noted that in FIG. 9B, a boundary line between the first and second layer 40, 50 and the base film 30 is shown in an exaggerated fashion in consideration of visibility. This is also true with FIG. 9E.

The surfaces and sections as shown in FIGS. 9A to 9E can be observed by the use of a laser microscope or a scanning electron microscope (SEM). To observe a section of such a sample, a resin-embedded abrasive film can be mechanically abraded to produce a section for observation. Here, the "resin-embedded abrasive film" means an abrasive film as a sample which is embedded in a resin so as to be held in a stable fashion.

Figure 10:
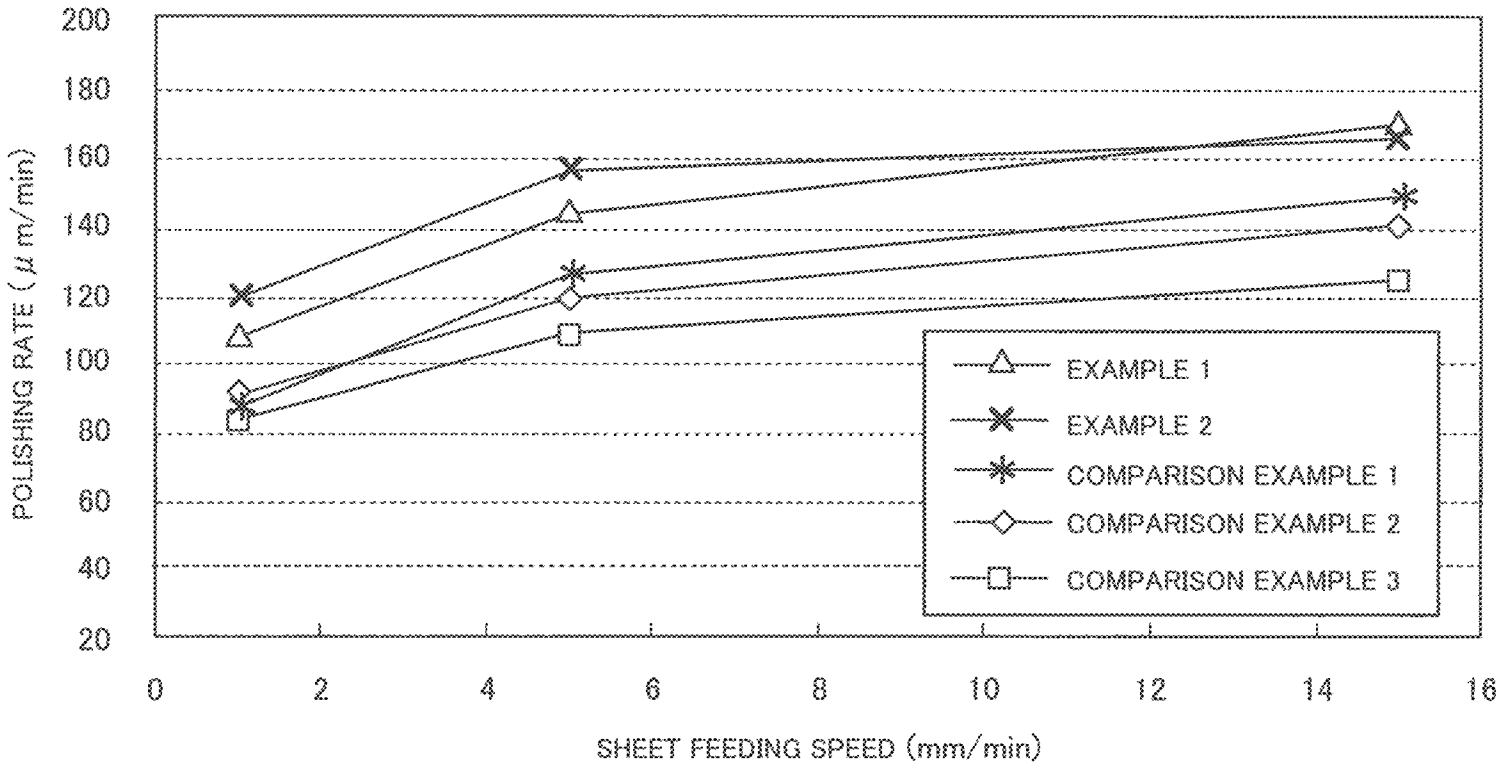
FIG. 10 is a diagram showing the results of the polishing tests (on a relation between sheet feed speed and polishing rate).

FIG. 10 shows the results of polishing tests carried out on the samples shown in FIGS. 8A and 8B. In the polishing tests, outer circumferential (end face) portions of silicone wafers having a diameter of 200 mm were polished, and polishing rates (variations in diameter) and surface roughness index values were measured. The polishing tests were carried out in a way described below. Firstly, a wafer was disposed horizontally on a polishing device, and was caused to be attracted and held to a rotating table. Next, the abrasive film was pushed from a rear thereof by a rubber pad while the abrasive film was fed minutely in a vertical direction, and the abrasive film was pressed against an end portion of the wafer perpendicularly for a predetermined period of time to polish the end portion. Then, a polishing rate was obtained from a change in wafer diameter before and after the working (polishing) step and the working time.

The polishing conditions of the polishing tests were as below:

(1) Polishing Load (pressure applied from the rubber pad): 12N (2) Rotational Speed of Wafer: 500 rpm (3) Polishing Time: 150 seconds (4) Sheet Feeding Speeds: 1 mm/min, 5 mm/min, 15 mm/min As shown in FIG. 10, Examples 1, 2 (the abrasive film 20) provided larger polishing rates than those of Comparison Examples 1 to 3 at any of the three sheet feeding speeds. In particular, under the condition where the sheet feeding speed was 1 mm/min, it could be confirmed that the polishing rate was enhanced by on the order of 50% relative to Comparison Example 1, which is the conventional abrasive film. In this way, an increase in polishing rate can reduce the amount of an abrasive film used to polish one wafer, thereby making it possible to realize a reduction in cost.

In addition, the abrasive films 20 of Examples 1, 2 provided polishing rates which were almost equal to each other. This indicates that performances which are almost equal to each other can be obtained whether the abrasive grains whose grain size distribution is sharp or the abrasive grains whose grain size distribution is broad are used. Namely, according to the abrasive film 20 of this embodiment, the accuracy with which the abrasive grains 60 are classified does not have to be enhanced to improve the performance. Consequently, the fabrication costs of the abrasive film 20 can be reduced.

FIG. 11 shows the results of measuring surface roughness index values in the polishing tests carried out. The surface roughness index values measured are expressed in arithmetic mean roughness Ra (μm) and largest root depth Pv (μm) of section curve. An atomic force microscope (AFM) was used for measurement. As shown in FIG. 11, the results of the measurement of Examples 1, 2 were as good as that of Comparison Example 1 representing a conventional abrasive film.

Figure 12:
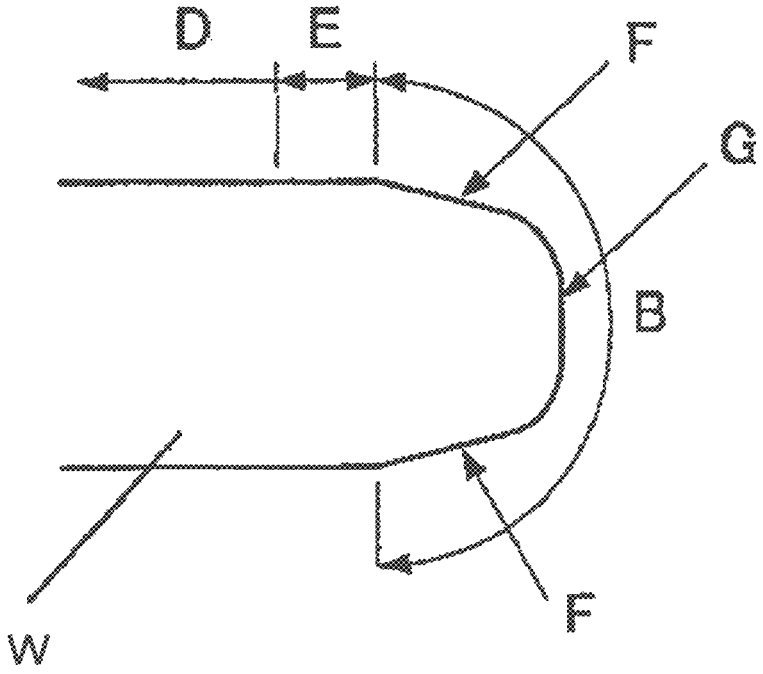
FIG. 12 is a diagram showing the periphery of a circumferential edge portion of a wafer.

The abrasive film 20 fabricated by the fabrication method that has been described heretofore can be used to polish a substrate by the use of a known substrate polishing system. A substrate can be polished by rotating the substrate and bringing the abrasive film 20 into contact with a portion of the substrate to be polished, or depending upon situations, pressing the abrasive film 20 against the portion. Various portions of the substrate can be so polished. For example, a circumferential edge portion of the substrate can be so polished. FIG. 12 shows the periphery of a circumferential edge portion of a wafer W as an example of a substrate. A flat portion D is an area where a device is formed and is situated several millimeters inwards from an end face G. A flat near-edge portion E is formed adjacent to the flat portion D. A bevel portion B is formed outwards of the near-edge portion E and extends from an upper inclined surface F to a lower inclined surface F through the end face G. The circumferential edge portion of the substrate which is the portion to be polished may be the bevel portion B. Although working pressure produced by the contact of the abrasive film 20 with the wafer W is locally concentrated at the bevel portion B, according to the abrasive film 20, the polishing can be executed preferably. The circumferential edge portion of the substrate is not, of course, limited to the bevel portion B. For example, the circumferential edge portion may be the near-edge portion E. The portion to be polished is not, of course, limited to the circumferential edge portion of the substrate but can be an arbitrary area of the wafer W. For example, the portion to be polished may be a rear surface of the wafer W.

Thus, while the embodiment of the invention has been described heretofore, the embodiment of the invention is so described to facilitate the understanding of the invention, and hence, the invention is not limited to the embodiment in any way. The invention can be modified or improved variously without departing from the spirit and scope thereof, and the invention includes, of course, equivalents thereof. In addition, the combination or omission of any of the constituent elements described in claims to be made hereafter and the specification is possible, provided that at least part of the problems described above can be solved or at least part of the advantages can be attained.

What is claimed is:

1. A method for fabricating an abrasive film, the method comprising:

preparing a base film, coating the base film with a first paint which contains no abrasive grain but contains a binder resin, and drying the first paint to form a first layer;

coating the first layer with a second paint which contains abrasive grains and the binder resin and drying the second paint to form a second layer; and heating the first layer and the second layer for imidization;

wherein a coating thickness of the first paint after being dried is in a range from a thickness equal to an average grain diameter of the abrasive grains to a thickness of three times as large as the average grain diameter.

2. The method according to claim 1, wherein the coating and drying comprises winding the base film on which the first layer and the second layer are formed into a roll with a separator sheet disposed on the second layer, and wherein the heating comprises imidizing the first layer and the second layer of the wound base film.

3. The method according to claim 2, wherein the heating is executed by heating the first and second layers in a vacuum baking furnace at temperature of 200° C. or higher and 350° C. or lower for one hour or longer and four hours or shorter.

4. The method according to claim 1, wherein the base film prepared is formed from polyimide.

5. The method according to claim 4, wherein the base film prepared is fully imidized.

6. The method according to claim 1, wherein the binder resin contains polyimide.

7. The method according to claim 1, wherein the first and second paints are prepared in the steps of comprising:

mixing the resin and a solvent; and degassing and deaerating in a vacuum chamber.

8. The method according to claim 1, wherein a thickness of the second layer after being dried is in a range from one fifth of an average grain diameter of the abrasive grains to one half of the average grain diameter of the abrasive grains.

9. The method according to claim 1, wherein the base film prepared has a thickness of 10 μm or larger and 50 μm or smaller.

10. A method for fabricating an abrasive film, the method comprising:

preparing a base film, coating the base film with a first paint which contains no abrasive grain but contains a binder resin, and drying the first paint to form a first layer;

coating the first layer with a second paint which contains abrasive grains and the binder resin, and drying the second paint to form a second layer; and heating the first layer and the second layer for imidization; wherein viscosities of the first paint and the second paint are prepared by a solvent to 10000 mPa·s/25° C. or larger and 30000 mPa·s/25° C. or smaller, wherein a ratio of a weight percentage of a resin solid content in the first paint to the whole of the first paint is 5 wt % or larger and 50 wt % or smaller, wherein a ratio of a weight percentage of the abrasive grains in the second paint to a resin solid content in the second paint is 5 wt % or larger and 30 wt % or smaller, and wherein a ratio of a weight percentage of the resin solid content in the second paint to the whole of the second paint is 10 wt % or larger and 50 wt % or smaller.

11. The method according to claim 10, wherein the ratio of a weight percentage of the resin solid content in the first paint to the whole of the first paint is 20 wt %, wherein the ratio of the weight percentage of the abrasive grains in the second paint to the resin solid content in the second paint is 15 wt %, and wherein the ratio of a weight percentage of the resin solid content in the second paint to the whole of the second paint is 18 wt %.

12. The method according to claim 10, wherein the solvent is an alkyl amide solvent.

13. A method for fabricating a polishing film, the method comprising:

preparing a film made of a thermosetting resin;

forming a first polymer layer on the film, wherein the layer contains no abrasive grain;

forming a second polymer layer on the first polymer layer, the second polymer layer containing abrasive grains;

drying the first polymer layer on the film after forming the first polymer layer and before forming the second polymer layer, and imidizing the first and the second polymer layers simultaneously by baking;

wherein a coating thickness of the first polymer layer after being dried is in a range from a thickness equal to an average grain diameter of the abrasive grains to a thickness of three times as large as the average grain diameter.

14. The method according to claim 13, further comprising:

winding the film on which the first and the second polymer layers are formed into a roll with a separator sheet disposed on the second polymer layer.

15. The method according to claim 14, wherein the first and second polymers are imidizied after the winding.

16. The method according to claim 15, wherein a winding shaft used for the winding kept oriented in a horizontal direction during the imidizing.

17. The method according to claim 13, wherein the imidizing is executed in a vacuum baking furnace at temperature of 200° C. or higher and 350° C. or lower for one hour or longer and four hours or shorter.

* * * * *